US005870826A

United States Patent [19]

Lewan

[11] Patent Number: 5,870,826

[45] Date of Patent: Feb. 16, 1999

[54] NAIL CLIPPER GRIPPING AID

[76] Inventor: Stephen J. Lewan, 14 Horseshoe Dr., Waterbury, Conn. 06706

[21] Appl. No.: 971,661

[22] Filed: Nov. 17, 1997

[51] Int. Cl.[6] ..... A45D 29/02

[52] U.S. Cl. ..... 30/28; 30/298

[58] Field of Search ..... 30/28, 232, 298, 30/291; 132/73.5

[56] References Cited

U.S. PATENT DOCUMENTS 3,744,131 7/1973 Manes .
3,997,966 12/1976 Sartore .
4,788,768 12/1988 Ohori ..... 30/28
5,052,416 10/1991 Rommerdale .
5,384,960 1/1995 Tottenham .
5,490,327 2/1996 Ohori ..... 30/28

*Primary Examiner*—Douglas D. Watts
*Attorney, Agent, or Firm*—Dallett Hoopes

[57] ABSTRACT

The aid comprises a channel including a central web and flanges extending in a first direction, the channel is formed with a fin extending in a second direction opposite the first direction. The fin has at least one finger opening therein. The usual nail clipper is mounted in the channel with the operating lever extending away from the aid so that it is readily operable.

7 Claims, 1 Drawing Sheet

NAIL CLIPPER GRIPPING AID

FIELD OF THE INVENTION

This invention relates to finger and toenail clippers. More specifically, the invention relates to an aid for making such clippers more comfortable, easier and accurate to use.

BACKGROUND OF THE INVENTION

Nail clippers utilizing a pair of leaf spring elements secured together at one end and having cutting edges at the other end are well known. Usually a fulcrum post is rotatably mounted on one of the elements adjacent its cutting edge and extends through the other element for support of a fulcrum lever used to move the cutting edges toward each other to produce cutting.

Attempts have been made in the past to provide structure or accouterments for such clippers so that they will be easier to use. An example is the Tottenham U.S. Pat. No. 5,384,960 wherein rings are provided on the ends of the lever and the spring elements, the rings being adapted to receive the fingers or thumb of the user to improve the grip.

U.S. Pat. No. 3,744,131 to Manes discloses a clipper having a finger hook and thumb piece on the respective lever and cutting element.

Rommerdale U.S. Pat. No. 5,052,416 discloses molded plastic attachments for the lever and a clipping element to make them easier to use.

Sartore U.S. Pat. No. 3,997,966 proposes scissor-like thumb and finger handles to make the apparatus easier to use and direct.

While these improvements provide some help, no one of them permits the involvement of the entire hand to hold and operate the clipper. With such involvement, as I now provide, the clipper is much easier and more comfortable to direct and operate.

SUMMARY OF THE INVENTION

The invention is, of course, defined in the appended claims. In summary, however, I provide an attachment for a toe and fingernail clipper well known in the art. The attachment is an aid which may be defined as a channel including a central web and flanges extending in a first direction, the channel is formed with a fin extending in a second direction opposite the first direction. The fin has at least one finger opening therein. The clipper is mounted in the channel with the operating lever extending away from the aid so that it is readily operable.

BRIEF DESCRIPTION OF THE DRAWINGS

Further objects and features of the invention will be clear to those skilled in the art from a review of the following specification and drawings, all of which present a non-limiting form of the invention. In the drawings.

DESCRIPTION OF THE PREFERRED EMBODIMENT

Figure 2:
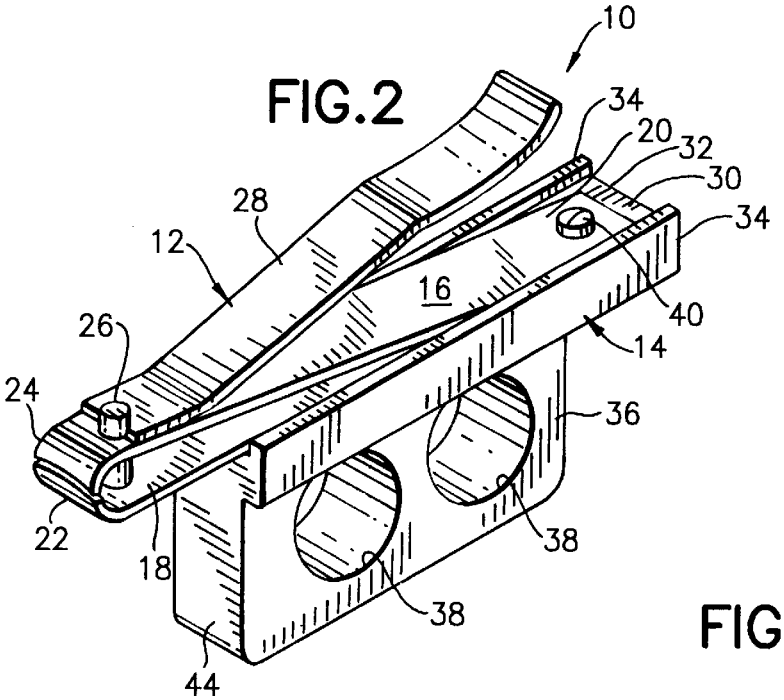
FIG. 2 is a perspective view.
Figure 3:
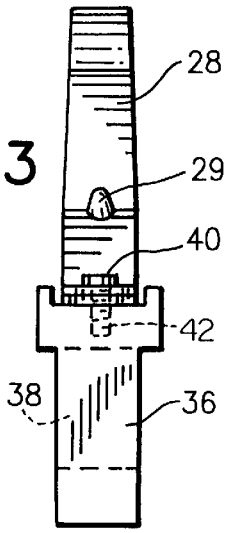
FIG. 3 is a rear elevational view.

A toenail clipper and the gripping aid is shown as an assembly in FIG. 2 and generally designated 10. It comprises the clipper 12 and the aid 14.

As is well known in the art, the clipper is defined by a pair of leaf spring elements 16 and 18. They are secured together at one end 20 as by a rivet or welding, and the second end of each is formed with a cutting edge 22, 24. A fulcrum post 26 has on its lower end a head (not shown) and extends through openings in the two elements 16, 18 and is formed with a notch (not shown) above element 16. The notch receives an end of an operating lever 28 having a downward pressure bump 29.

The gripping aid 14 is a single block of metal or plastic which comprises a channel 30 including a web 32 and two side flanges 34. A fin 36 extends in a direction opposite the direction of the flanges 34 from the underside of the channel. It is formed preferably with a pair of finger openings 38.

As shown, a single bolt 40 passes through a hole in the end 20 of the clipper and is screwed into a tapped bore 42 in the channel 30. This secures the clipper in the aid 14 and, when tightened, effectively holds the clipper. The flanges 34 of the channel 30 keep the aid from rotating relative to the clipper.

Alternatively, the clipper can be secured in the channel 30 by an epoxy cement.

It should further be understood that the aid as described may also be used with a fingernail clipper (not shown) which is shorter than the toenail clipper 12. In securing the fingernail clipper, the bolt 40 may be secured to the aid 14 about midway along the channel as shown in FIG. 2. In other words, the bolt and the bore 42 may be, for instance, somewhat inbetween the openings 38. This is because, of course, the elements 16 and 18 of the fingernail clipper are shorter than those shown, and it is desirable to have the cutting edges 22, 24 extend beyond the front end of the fin 44.

Figure 1:
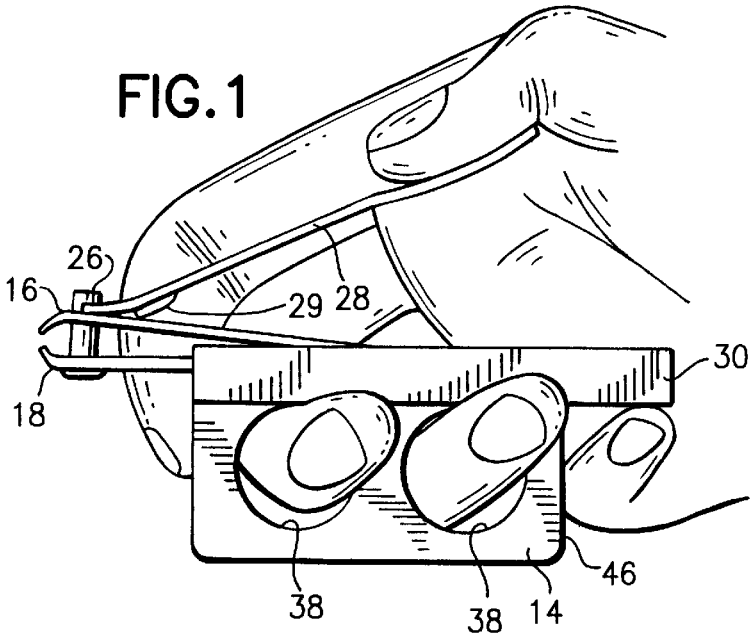
FIG. 1 is a side elevation of a toenail clipper installed in a gripping aid embodying the invention. The assembly is shown held in a hand as it would be in use.

Thus, as shown in FIG. 1, the index finger can conveniently rest upwardly against the underside of the leaf spring element 18 irrespective of whether a toenail or fingernail clipper is installed in the aid. The channel 30 preferably extends beyond the rear end 46 of the fin 36 so that it may be engaged by the little finger.

Many of the benefits of the invention can be achieved by the use of an aid 14 wherein the channel 30 is replaced by a single web 32 without flanges 34, the upper surface of the web 32 serving to engage the underside of the clipper. In such a case, an epoxy cement may secure the aid 14 to the clipper 12.

The convenient benefit of the clipper being collapsible can still be enjoyed using the aid, as the operating lever 28 can be swiveled about the axis of the post 26 and then flopped over so that the lever 28 engages the leaf spring element 16.

Variations in the invention are possible. Thus, while the invention has been shown in only one embodiment, it is not so limited but is of a scope defined by the following claim language which may be broadened by an extension of the right to exclude others from making, using or selling the invention as is appropriate under the doctrine of equivalents.

What is claimed is:

1. In assembly, a nail clipper for cutting finger or toenails and a gripping aid, said nail clipper comprising:

a. first and second leaf spring elements joined together at one end and each having a cutting edge at a second end, said cutting edges having a normal position wherein the cutting edges are spaced apart;

b. an operating lever contacting one of said first and second leaf spring elements for moving the cutting edge of said one element from said normal position toward the cutting edge of the other element to a cutting position;

c. said operating lever being rotatable about a fulcrum post which passes through both said first and second elements;

said gripping aid comprising:

a. a channel defined by a central web and flanges extending in a first direction, the channel formed with a fin extending in a second direction opposite the first direction, the fin having at least one finger opening therein, the other of said first and second leaf spring elements being at least partly disposed in the channel between the flanges, the channel of the gripping aid extending beyond the end of the fin more removed from the second ends of the leaf spring elements, and b. securing means securing said second leaf spring element in the channel.

2. An assembly as claimed in claim 1 wherein the fin is formed with a pair of side-by-side finger openings.

3. A nail clipper and gripping aid as claimed in claim 1 wherein the securing means is a bolt which extends through a hole formed at the one end of the nail clipper and threadedly engages a threaded bore in the gripping aid.

4. A gripping aid for a nail clipper, the nail clipper comprising:

a. first and second leaf spring elements joined together at one end and each having a cutting edge at a second end, said cutting edges having a normal position wherein the cutting edges are spaced apart;

b. an operating lever contacting one of said first and second leaf spring elements for moving the cutting edge of said one member from said normal position toward the cutting edge of said second member to a cutting position;

c. said operating lever being rotatable about a fulcrum post which passes through both said first and second elements;

said gripping aid comprising:

a. a channel defined by a central web and flanges extending in a first direction, the channel formed with a fin extending in a second direction opposite the first direction, the fin having a pair of side-by-side finger receiving openings therein, the other of said first and second leaf spring elements being at least partly disposed in the channel between the flanges and, b. securing means adapted to secure the nail clipper in the channel.

5. A nail clipper and gripping aid as claimed in claim 4 wherein the channel of the gripping aid extends beyond an end of the fin.

6. A nail clipper and gripping aid as claimed in claim 4 wherein the securing means is a bolt which is adapted to extend through a hole formed at the one end of the nail clipper and threadedly engages a threaded bore in the gripping aid.

7. In assembly, a nail clipper for cutting finger or toenails and a gripping aid, said nail clipper comprising:

a. first and second leaf spring elements joined together at one end and each having a cutting edge at a second end, said cutting edges having a normal position wherein the cutting edges are spaced apart;

b. an operating lever contacting one of said first and second leaf spring elements for moving the cutting edge of said one element from said normal position toward the cutting edge of the other element to a cutting position;

c. said operating lever being rotatable about a fulcrum post which passes through both said first and second elements;

said gripping aid comprising:

a. a channel defined by a central web and flanges extending in a first direction, the channel formed with a fin extending in a second direction opposite the first direction, the fin being formed with a pair of side-by-side finger openings therein, the other of said first and second leaf spring elements being at least partly disposed in the channel between the flanges, and b. securing means securing said second leaf spring element in the channel.

* * * * *